US005484297A

United States Patent [19]

Takahashi et al.

[11] Patent Number: 5,484,297

[45] Date of Patent: Jan. 16, 1996

[54] LEVER FITTING-TYPE CONNECTOR

[75] Inventors: Hiroki Takahashi; Motoyoshi Suzuki; Naoto Taguchi, all of Shizuoka, Japan

[73] Assignee: Yazaki Corporation, Tokyo, Japan

[21] Appl. No.: 312,798

[22] Filed: Sep. 27, 1994

[30] Foreign Application Priority Data

| | | | |
|---|---|---|---|
| Sep. 27, 1993 | [JP] | Japan | 5-239295 |
| Oct. 4, 1993 | [JP] | Japan | 5-247721 |
| Oct. 4, 1993 | [JP] | Japan | 5-247722 |

[51] Int. Cl.[6] ..... H01R 13/62

[52] U.S. Cl. ..... 439/157; 439/155

[58] Field of Search ..... 439/152–160, 439/372

[56] References Cited

U.S. PATENT DOCUMENTS

| | | | |
|---|---|---|---|
| 4,947,289 | 8/1990 | Dynie | 361/415 |
| 5,000,692 | 3/1991 | Taniguchi et al. | 439/160 |
| 5,104,330 | 4/1992 | Yagi et al. | 439/157 |
| 5,139,430 | 8/1992 | Lewis et al. | 439/157 |
| 5,269,696 | 12/1993 | Okada et al. | 439/140 |
| 5,273,447 | 12/1993 | Heiney et al. | 439/160 |
| 5,330,362 | 7/1994 | Ito et al. | 439/157 |
| 5,344,194 | 9/1994 | Hatagishi et al. | 285/26 |
| 5,363,281 | 11/1994 | Baitz et al. | 361/801 |
| 5,373,419 | 12/1994 | Wright | 361/755 |

FOREIGN PATENT DOCUMENTS

| | | | |
|---|---|---|---|
| 2260865 | 4/1993 | United Kingdom | 439/157 |

*Primary Examiner*—Larry I. Schwartz
*Assistant Examiner*—Jill DeMello
*Attorney, Agent, or Firm*—Sughrue, Mion, Zinn, Macpeak & Seas

[57] ABSTRACT

A lever fitting-type connector includes a lever returning spring having a connector-side engagement lever and a lever-side engagement lever which extend from a coil portion, a connector housing including a shaft portion and one spring end engagement portion which are formed on an outer wall surface thereof, and the one spring end engagement portion engaged with the connector-side engagement lever; and a U-shaped lever having an engagement hole for the shaft portion and the other spring end engagement portion which is engaged with the lever side coil portion.

7 Claims, 12 Drawing Sheets

LEVER FITTING-TYPE CONNECTOR

BACKGROUND OF THE INVENTION

1. Field of the Invention

This invention relates to a lever fitting-type connector in which a lever-returning spring member and a connector-fitting lever can be easily mounted on a connector housing, relates to a construction and a method for easily mounting a lever-returning spring on a lever fitting-type connector, and relates to a lever fitting-type connector in which a restoring ability of a spring-biased, connector-fitting lever is enhanced, and the increase of the size of the connector due to the use of a spring member is prevented.

2. Related Art

One conventional lever fitting-type connector is disclosed in U.S. Pat. No. 5,174,785.

In FIGS. 1 and 2, reference characters A and B denote a female connector and a male connector, respectively. The female connector A contains pin-like male terminals C and U-shaped short-circuit terminals C', and the male connector B contains female terminals (not shown). The female connector A is attached to an electronic unit (not shown) to be mounted on a vehicle, and the proximal ends of the pin-like terminals C are soldered to a circuit of a printed circuit board 1.

The male connector B is a multi-pole connector having many terminal receiving chambers 3 arranged in upper and lower rows. Its insulative housing 4 is divided by slits 5 into three sections B1, B2 and B3, and the female terminal is received in each receiving chamber 3, and is retained there by a known means.

Pins 6 are projectingly formed respectively on the opposite sides of the housing 4 of the male connector B, and provisional retaining projections 7 are formed on its upper surface at opposite side portions thereof, and an elastic lock arm 8 is provided on the central portion of the upper surface. As shown in FIG. 1, the elastic lock arm 8 has a lock portion 9 having a tapered engaging surface. A cover 10 is attached to the electric wire lead-out side of the male connector B, and is locked thereto by lock means 11*a* and 11*b*.

The female connector A has at its front side a hood 12 for receiving the male connector B, and the hood 12 is divided by partition walls 13 into three chambers $\mathbf{12}_1$, $\mathbf{12}_2$ and $\mathbf{12}_3$ in corresponding relation to the male connector B. As shown in FIG. 2, the U-shaped short-circuit terminals C' are provided to be extended from an outer wall 12*a* of the chamber $\mathbf{12}_3$ into the interior of this chamber.

A lever member F is pivotally mounted on the hood 12, and comprises a pair of cam levers 19 for effecting the fitting and disengagement relative to the male connector B, and an operating plate 20 interconnecting the two levers 19.

Namely, the hood 12 has at its opposite (right and left) sides lever-mounting chambers 14 each having double (inner and outer) walls, and each cam lever 19 is pivotally mounted on a pin-like shaft 16 fixedly mounted in a shaft hole 15 in the chamber 14. A groove 17 is formed in the inner wall of each of the mounting chambers 14, and the pin 6 of the male connector B is moved into and out of the groove 17. The hood 12 has retaining grooves for the provisional retaining projections 7 of the male connector B.

Each cam lever 19 has at its front end an eccentric cam groove 21 for engagement with the pin 6 of the male connector B, and a coil spring (resilient member) is interposed between the operating plate 20 and a central recess 12*b* in the upper wall of the hood 12, so that the operating plate 20 and the cam levers 19 are urged upward to be upstanding relative to the upper surface of the hood 12 in a normal condition.

In the above construction, however, the coil spring can not be handled easily during the assembling of the connector, and the assembling efficiency has been quite poor.

SUMMARY OF THE INVENTION

With the foregoing in view, it is an object of this invention to provide a lever fitting-type connector in which a lever-returning spring can be easily mounted on a connector housing, and also to provide a method of mounting such a lever-returning spring.

With the foregoing in view, it is another object of this invention to provide a lever fitting-type connector in which a lever-returning spring member and a lever can be easily mounted on a connector housing.

With the foregoing in view, it is another object of this invention to provide a lever fitting-type connector in which a returning (opening) movement of a lever will not be deteriorated, and the increase of the size of the connector due to the use of a spring member can be prevented, and the spring member is less liable to be disengaged.

To achieve the above object, the present invention provides a lever fitting-type connector comprising a lever-returning spring having a connector-side engagement lever and a lever-side engagement lever which extend from a coil portion; and a connector housing which has an insertion shaft for said coil portion, and has a retaining pawl and an insertion hole for said connector-side engagement lever; wherein said connector-side engagement lever of said lever-returning spring is formed straight; and said insertion hole for a straight distal end portion of said connector-side engagement lever is formed in said connector housing in a connector fitting direction.

The present invention also provides a method of pushingly mounting a lever-returning spring on a connector housing which has an insertion shaft for a coil portion of said lever-returning spring, and has a retaining pawl and an insertion hole for a connector-side engagement lever of said lever-returning lever; wherein a straight distal end portion of said connector-side engagement lever is inserted obliquely into said insertion hole formed in said connector housing in a connector fitting direction, so that said lever-returning spring is disposed in a tilted manner in opposed relation to said retaining pawl and said insertion shaft; and said lever-returning spring is pressed down, using said straight distal end portion as a fulcrum, thereby engaging said spring with said retaining pawl and said insertion shaft.

To achieve the above object, the present invention provides a lever fitting-type connector comprising a connector housing having a shaft portion and a spring end engagement portion which are formed on an outer wall surface thereof; a spring member having a coil portion for said shaft portion, as well as a connector-side engagement lever and a lever-side engagement lever which extend from said coil portion along said outer wall surface; and a generally U-shaped lever having an engagement hole for said shaft portion and another spring end engagement portion; wherein said another spring end engagement portion is defined by a longitudinal insertion portion for said straight lever-side engagement lever, said insertion portion being formed at an inner wall surface of said lever extending along said outer wall surface; and said coil portion is engaged with said shaft portion, and said connector-side engagement lever is engaged with said spring end engagement portion, whereas said lever-side engagement lever extends outwardly from said connector housing in an upstanding manner, so that said lever-side engagement lever can be inserted into said insertion portion in a lever-mounting direction.

Preferably, a notched portion having a guide surface for said shaft portion is formed in the inner wall surface of said lever, and extends from an outer edge of said inner wall surface to said engagement hole.

To achieve the above object, the present invention provides a lever fitting-type connector wherein a hole in a connector-fitting lever is fitted on a shaft portion formed in a projected manner on a connector housing; wherein a central portion of a volute spring member is fixedly mounted on said shaft portion; one end portion of said spring member is fixedly secured to said connector housing; and the other end portion of said spring member is fixedly secured to said lever.

Preferably, said spring member includes a volute portion volute in a one-dimensional direction, a straight portion which extends from an inner peripheral portion of said volute portion, and further extends through the center of said volute portion outwardly, one bent end portion formed at a distal end of said straight portion, and the other bent end portion which extends from an outer peripheral portion of said volute portion, and is bent in a direction opposite to said one bent end portion; said shaft portion has an engagement groove for said straight portion; said connector housing has an insertion hole for said one bent end portion; and said lever has an insertion hole for said other bent end portion.

The straight distal end portion of the connector-side engagement lever of the lever-returning spring is obliquely inserted into the insertion hole in the connector fitting direction, so that the lever-returning spring produces a pressing force in a direction to engage the retaining pawl because of a resilient reaction force of the connector-side engagement lever. In the condition in which this pressing force acts in an auxiliary manner, the lever-returning spring is pressed down, so that the connector-side engagement lever can easily slide over the retaining pawl, and at the same time the coil portion is engaged with the insertion shaft.

For mounting the lever, the outer wall surface of the connector housing is disposed along the inner wall surface of the lever, and in this condition the lever-side engagement lever of the spring member, projected beyond the connector housing, is inserted into the insertion portion for the lever.

Then, the shaft portion of the connector housing moves in sliding contact with the guide surface of the notched portion in the inner wall surface of the lever, and is guided to the engagement hole for the lever, and is engaged therein.

The volute spring member is located on the axis of pivotal movement of the lever, and causes this lever to pivotally move in an opening direction with a generally constant, stable torque. During the opening and closing movement of the lever, the volute portion of the spring member increases and decreases in diameter in a one-dimensional direction. Therefore, the spring member does not occupy much space in a direction of the width of the connector (that is, a direction perpendicular to the spring member). When the lever is mounted, the spring member, engaged with the shaft portion, is held between the connector housing and the lever, thereby preventing the spring member from being disengaged.

DETAILED DESCRIPTION OF THE PREFERRED EMBODIMENTS

First embodiment

Figure 1:
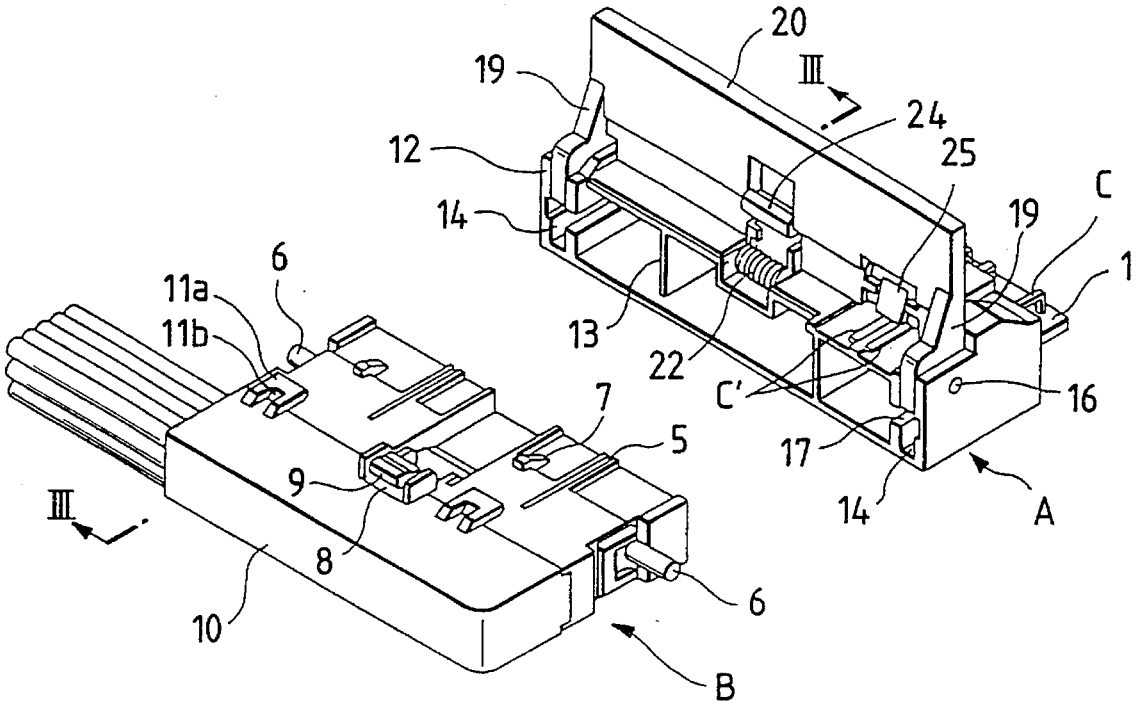
FIG. 1 PRIOR ART
FIG. 1 is a perspective view of a conventional electric connector, showing connectors in a spaced-apart condition.
Figure 2:
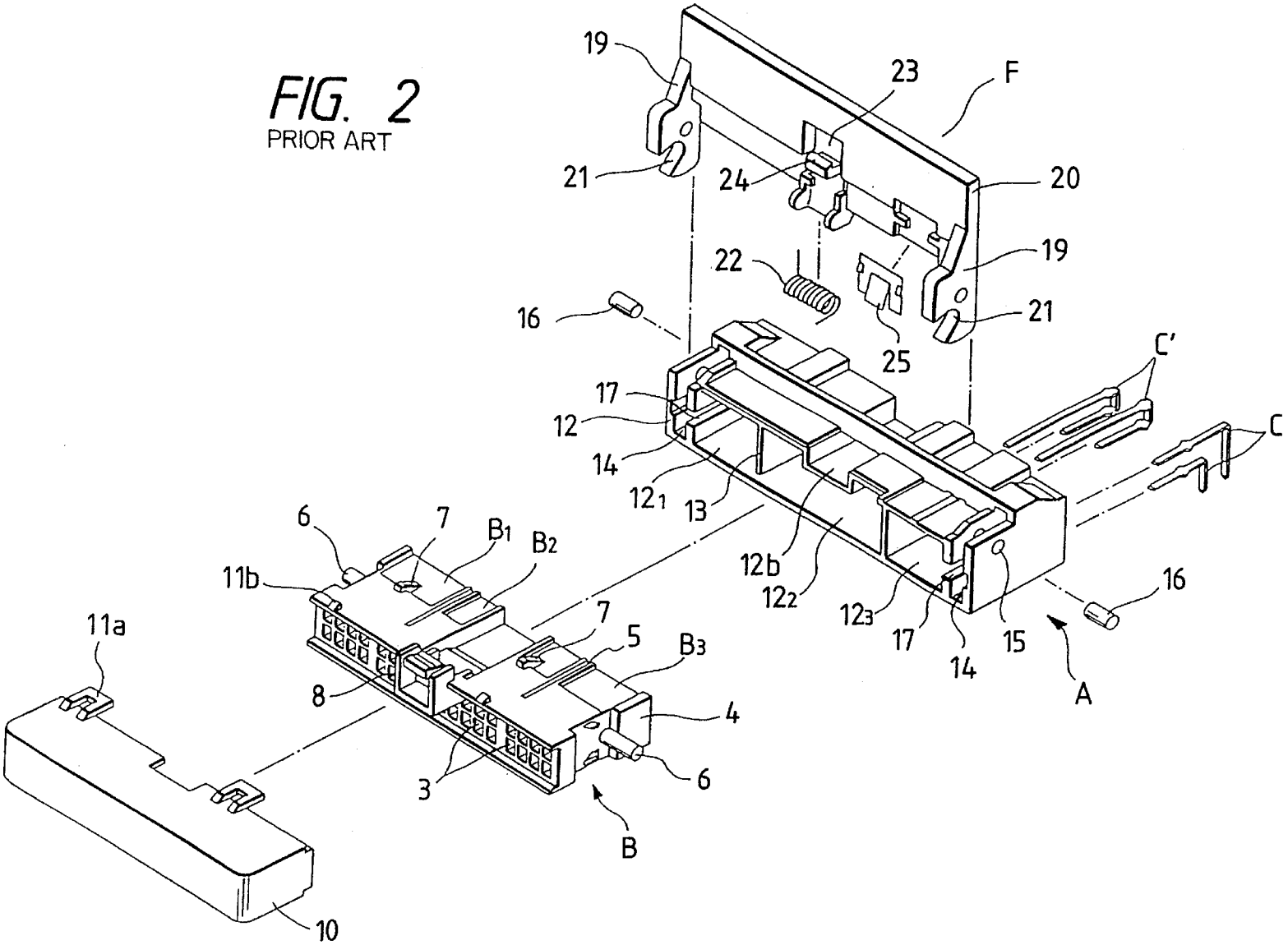
FIG. 2 PRIOR ART
FIG. 2 is an exploded, perspective view of the above connector.
Figure 3A:
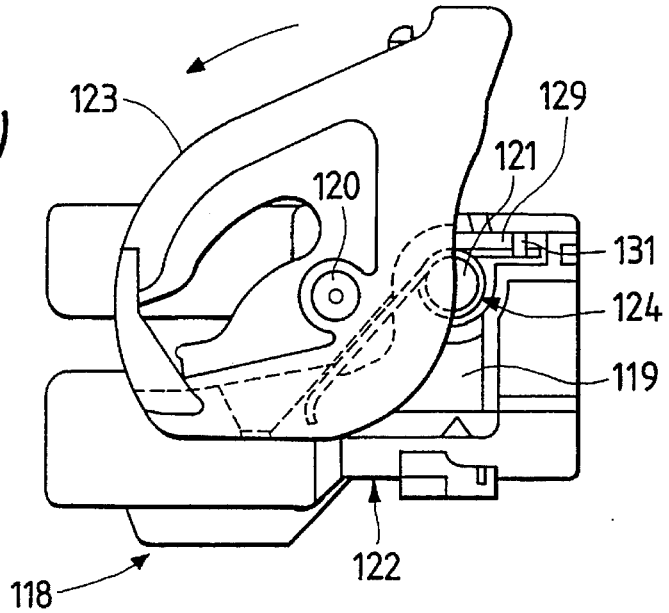
FIGS. 3(*a*) to 3(*d*) are views showing a first embodiment of a lever fitting-type connector of the present invention (An encircled portion is an enlarged, exploded perspective view showing a lever-returning spring and so on)
Figure 3B:
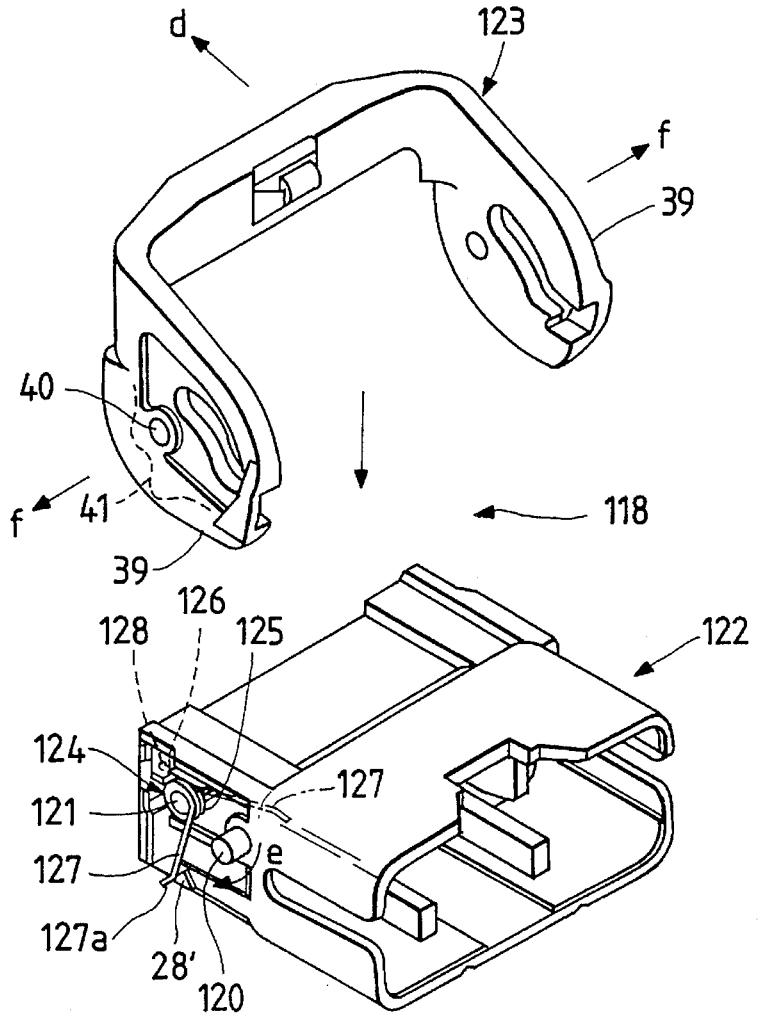
Figure 3C:
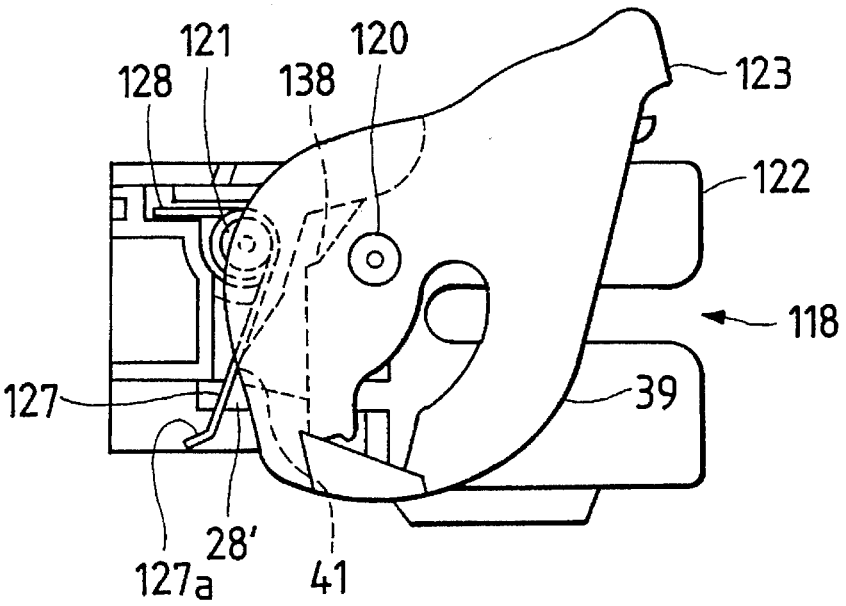
Figure 3D:
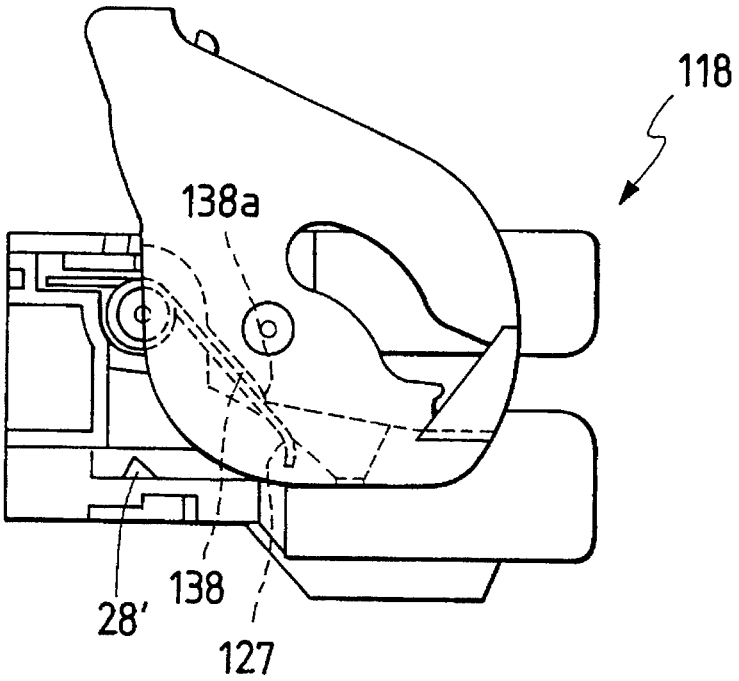

FIGS. 3(*a*) to (*d*) show a first embodiment of a lever fitting-type connector of the present invention.

This lever fitting-type connector 118 comprises a connector housing 122 of a synthetic resin having two insertion shafts 120 and 121 formed on one side wall 119, a connector-fitting lever 123 pivotally mounted on the front insertion shafts 120, and a lever-returning spring 124 (in the form of a torsion coil spring) mounted on the rear insertion shaft 121 to urge the lever 123 in an opening direction.

Figure 4:
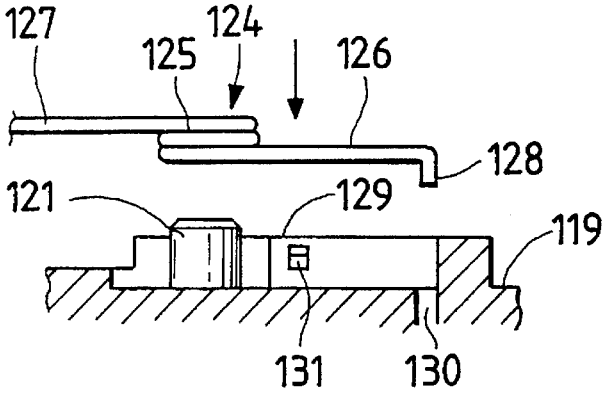
FIG. 4 is a cross-sectional view showing a method of mounting the lever-returning spring on a connector housing.

As shown in FIG. 4, the lever-returning spring 124 includes a coil portion 125, a connector-side engagement lever 126 extending from the coil portion 125, and a lever-side fitting lever 127 extending from the coil portion 125. The connector-side engagement lever 126 has a perpendicularly-bent portion 128 at its distal end. A guide wall 129 for the coil portion 125 and the connector-side engagement lever 126, the insertion shaft 121 for the coil portion 125, and an insertion hole 130 for the bent end portion 128 are provided at the side wall 119. A retaining pawl 131 for the connector-side engagement lever 126 is formed on the guide wall 129.

Figure 5:
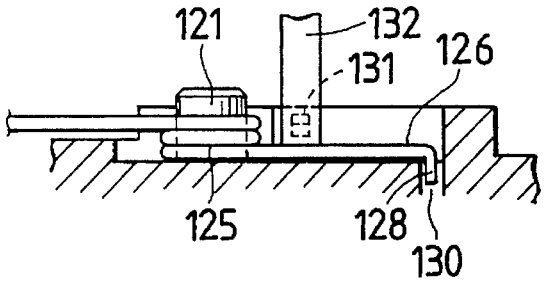
FIG. 5 is a cross-sectional view showing a condition in which the spring is mounted.

As shown in FIG. 5, by the use of a press-attaching tool 132, the connector-side engagement lever 126 of the lever-returning spring 124 is forcibly caused to slide over the retaining pawl 131 to be engaged therewith, and at the same time the coil portion 125 is fitted on the insertion shaft 121, and also the bent end portion 128 is engaged in the insertion hole 130.

However, in the above construction and method of mounting the lever-returning spring, there has been encountered a problem that an extensive spring mounting operation using the press-attaching tool 132 is needed, thus requiring much time and labor for mounting the spring.

In view of the foregoing, a second embodiment of the present invention seeks to provide a lever fitting type connector, as well as a method of mounting a lever-returning spring, in which the lever-returning spring can be easily mounted on a connector housing.

Second embodiment

Figure 6:
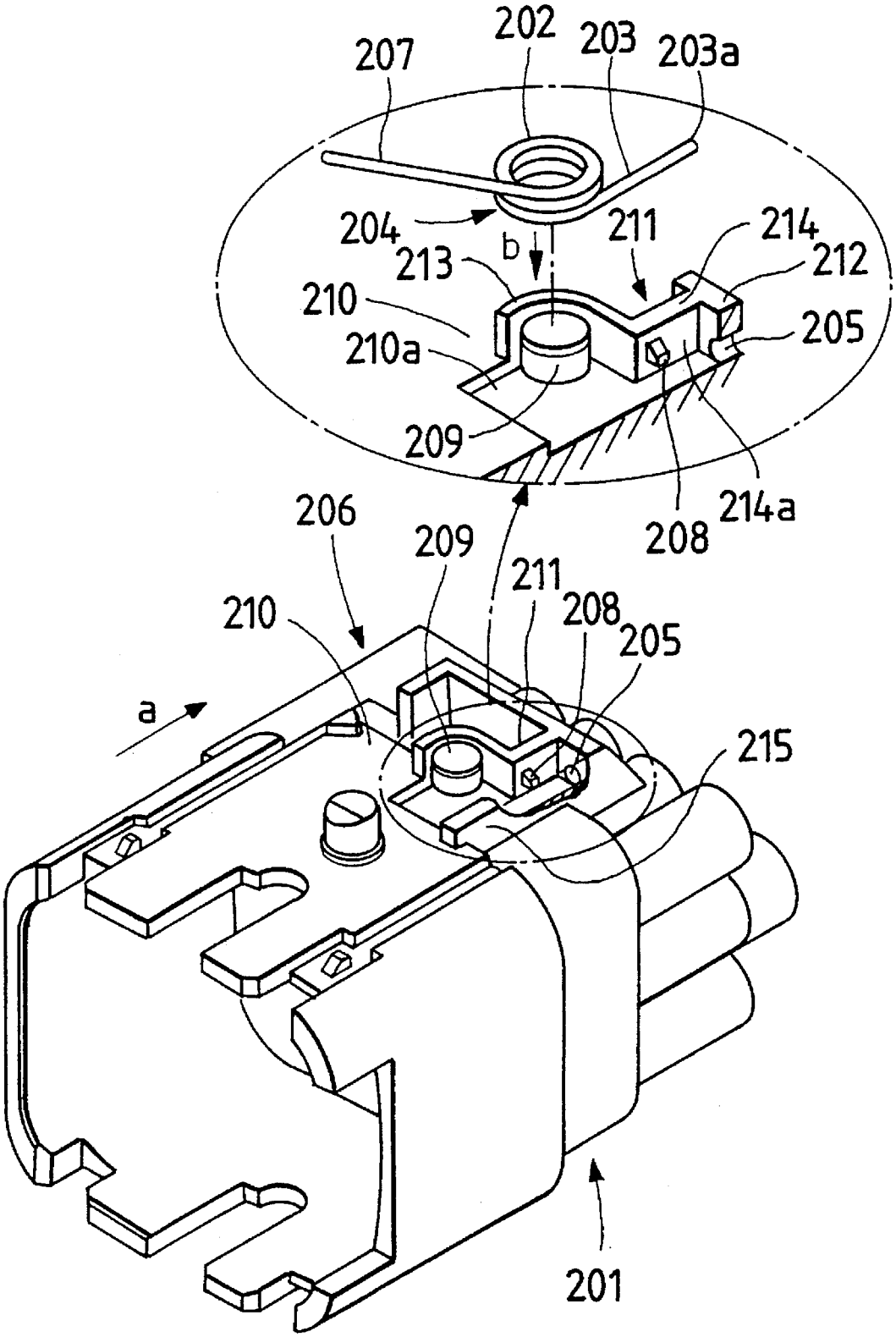
FIG. 6 is a perspective view showing a second embodiment of a lever fitting-type connector of the invention.

FIG. 6 shows a second embodiment of a lever fitting-type connector of the invention. A connector-fitting lever used here is the same as that of the preceding embodiment, and therefore the showing thereof is omitted here.

This lever fitting-type connector 201 comprises a lever-returning spring 204 (in the form of a torsion coil spring) having a straight connector-side engagement lever 203 extending from one side of a coil portion 202, and a connector housing 206 having an insertion hole 205 for a straight distal end portion 203*a* of the connector-side engagement lever 203, the insertion hole 205 extending in a connector fitting direction indicated by arrow a.

As in the preceding embodiment, the lever-returning spring 204 has a lever-side engagement lever 207 extending from the other side of the coil portion 202. The straight connector-side engagement lever 203 of the lever-returning spring 204 is engaged with a retaining pawl 208 and the insertion hole 205 of the connector housing 206, and the coil portion 202 is somewhat loosely fitted on an insertion shaft 209, and in this condition the lever (not shown) is urged in an opening direction by the lever-side engagement lever 207.

The insertion hole 205 in the connector housing 206 is formed through a rear end portion 212 of a spring guide wall 211 formed on a housing side wall 210. The spring guide wall 211 includes a semi-circular portion 213 partially surrounding the insertion shaft 209 formed on the housing side wall 210, a straight portion 214 extending from the semi-circular portion 213 in the longitudinal direction of the connector (that is, in the fitting direction), and the rear end portion 212 perpendicularly intersecting the straight portion 214. The retaining pawl 208 is formed on an inner surface 214*a* of the straight portion 214. In this embodiment, a spring mounting surface 210*a* on the housing side wall 210 is recessed into a groove-like configuration, and a guide wall 215 is formed thereon in opposed relation to the spring guide wall 211. The insertion hole 205 is provided on an extension of-the spring mounting surface 210*a*, with no step formed thereon.

Figure 7:
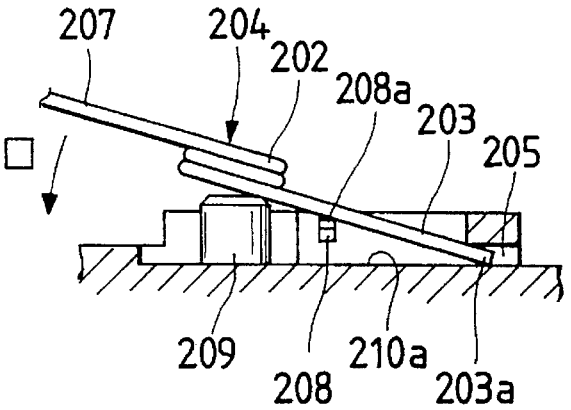
FIG. 7 is a cross-sectional view showing a manner of mounting a lever-returning spring on a connector housing.
Figure 8:
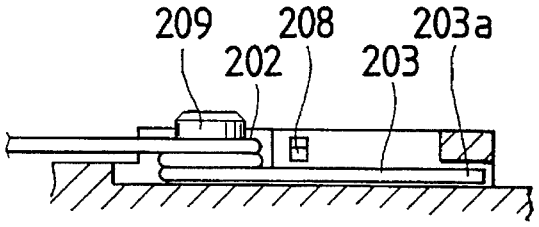
FIG. 8 is a cross-sectional view showing a condition in which the spring is mounted on the connector housing.

As shown in FIG. 7, the straight distal end portion 203*a* of the connector-side engagement lever 203 is pressed down between the two guide walls 211 and 215 to tilt the lever-returning lever 204, and in this condition the straight distal end portion 203*a* is inserted into the insertion hole 205 along the spring mounting surface 210*a*. The straight distal end portion 203*a* is resiliently bent, and is inserted straight into the insertion hole 205, so that a reaction force for urging the lever-returning spring 204 toward the spring mounting surface 210*a* (in a direction of arrow b) is produced. By this reaction force, the connector-side engagement lever 203 is brought into abutment against an upper slanting slide surface 208*a* of the retaining pawl 208.

In this condition, when the lever-side engagement lever 207 of the lever-returning spring 204 is pressed down in the direction of arrow b, the connector-side engagement lever 203 urged in this direction can easily slide over the retaining pawl 208 by a reaction force, and is engaged therewith, and at the same time the coil portion 202 is fitted on the insertion shaft 209.

As described above, in the second embodiment of the invention, the straight distal end portion of the connector-side engagement lever of the lever-returning spring is inserted obliquely into the insertion hole of the connector housing extending in the connector fitting direction, thereby producing a resilient reaction force, and with the aid of this resilient reaction force, the connector-side engagement lever can easily slide over the retaining pawl to be engaged therewith. Therefore, the lever-returning spring can be mounted by the fingers of the operator, thus enhancing the operating efficiency, and the heavy press-attaching tool as used in the preceding embodiment does not need to be used, and the time required for the operation is greatly shortened. And besides, the connector-side engagement lever of the lever-returning spring does not need to be provided with a bent portion as in the preceding embodiment, and therefore the manufacturing cost of the spring-returning lever is reduced.

In the meantime, according to the first embodiment of the present invention, before the lever is mounted, the lever-side engagement lever 127 is pivotally moved by the finger in a direction of arrow e to be engaged with a provisional spring-retaining projection 28' for provisional retaining purposes, as shown in FIG. 3(*b*). In this condition, opposite side walls 39 of the lever 123 are urged way from each other as indicated by arrows f, and engagement holes 40, formed respectively in the opposite side walls 39, are fitted respectively on the front shafts 120. Then, as shown in FIG. 3(*c*), in accordance with the lever closing movement, the lever-side engagement lever 127 is urged out of engagement with the provisional retaining projection 28' by a thin, cam-like protuberance 41 formed on an inner surface of the lever side wall, and is brought into engagement with a spring end engagement groove 138, as shown in FIG. 3(*d*).

However, in the above construction of the first embodiment, when engaging the lever-side engagement lever 127 with the provisional retaining projection 28', this lever-side engagement lever 127 is liable to be easily disengaged from the provisional retaining projection 28', and therefore the mounting operation is quite troublesome. Moreover, when the lever 123 is to be mounted on the connector housing 122, the opposite side walls 39 of the lever must be forcibly moved away from each other, and thus the mounting efficiency is not entirely satisfactory.

Third embodiment

In view of the foregoing, a third embodiment of the invention seeks to provide a lever fitting-type connector in which a lever-returning spring member, as well as a lever, can be easily mounted on a connector housing.

Figure 9:
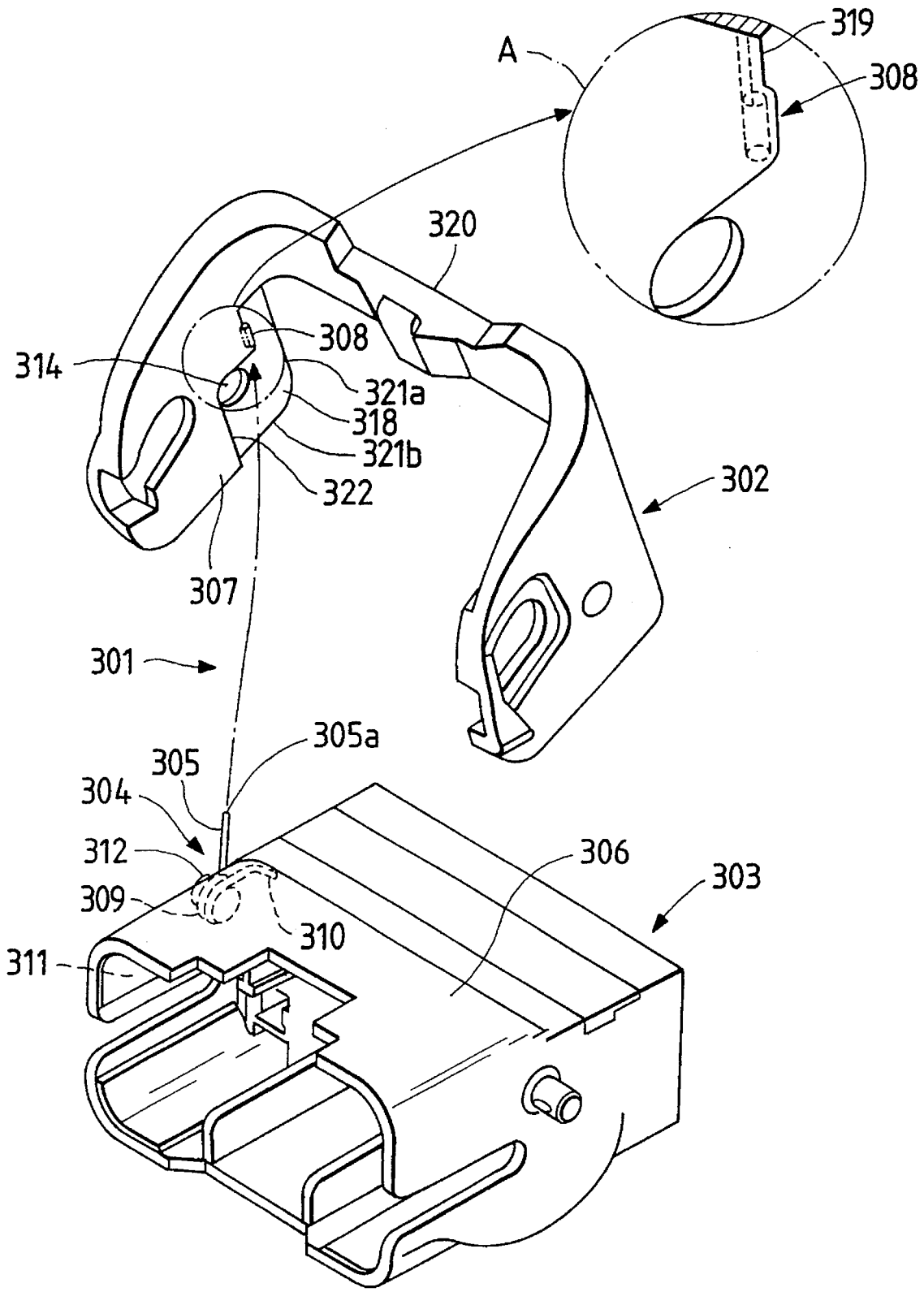
FIG. 9 is an exploded perspective view showing a third embodiment of a lever fitting-type connector of the invention (An encircled portion is an enlarged view)
Figure 10:
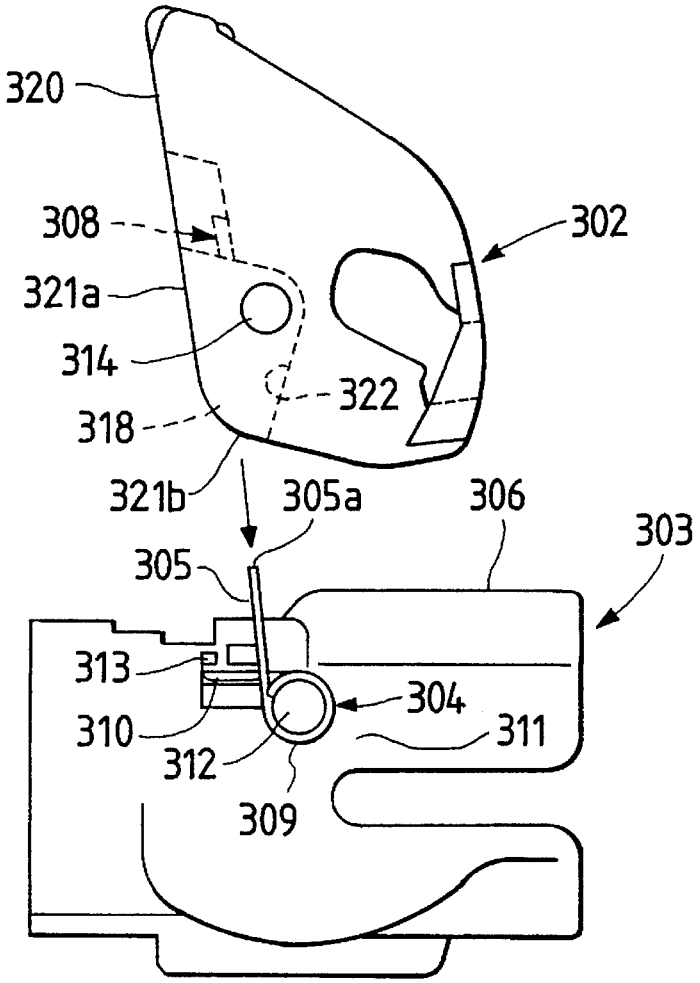
FIG. 10 is a side-elevational view.

FIGS. 9 and 10 show a third embodiment of a lever fitting-type connector of the invention.

In this lever fitting-type connector 301, before a lever 302 is mounted, a straight lever-side engagement lever 305 of a spring member 304 mounted on a connector housing 303 projects upwardly from a top wall 306 of the connector housing 303 in an upstanding manner, and a distal end portion 305*a* of the lever-side engagement lever 305 can be inserted into an insertion portion 308 formed in an inner surface 307 of the generally U-shaped lever 302, the insertion portion 308 extending in a longitudinal direction of the lever-side engagement lever.

As in the above embodiment, the spring member 304 includes a coil portion 309, a connector-side engagement lever 310, and the lever-side engagement lever 305. The lever-side engagement lever 305 in its free condition is disposed generally perpendicular to the horizontally-disposed connector-side engagement lever 310, and projects upwardly beyond the housing top wall 306, as shown in FIG. 10. The connector housing 303 has at its one side wall 311 a shaft portion 312 and a spring end engagement portion 313 disposed rearwardly of this shaft portion 312. The coil portion 309 of the spring member 304, as well as an engagement hole 314 in the lever 302, is fitted on the shaft portion 312.

Figure 11:
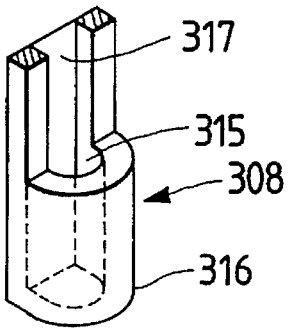
FIG. 11 is an enlarged, perspective view of a portion A of FIG. 9.

An insertion portion 308, serving as a spring end engagement portion, is formed in an inner surface 307 of the lever 302. As shown in FIG. 11 showing a portion A indicated by arrow A of FIG. 9, the insertion portion 308 includes a semi-cylindrical, arch-like portion 316 forming an insertion hole 315, and an engagement groove 317 continuous with the insertion hole 315. The arch portion 316 projects from an inner edge 319 of a notched portion 318, formed in the lever inner surface 307, toward a lever operating wall 320, and the insertion hole 315 and the engagement groove 317 are communicated with each other in a direction parallel to the lever operating wall 320.

In order to provide the insertion portion 308, the notched portion 318 is formed by cutting the relevant portion from an outer edge 321*a* (disposed close to the lever operating wall, that is, the upper side) in parallel relation to the side wall, and further by cutting the relevant portion to the engagement hole 314 from the outer edge 321*a* and a rear outer edge 321*b*, and this notched portion has a guide surface 322 extending from the rear outer edge 321*b* toward the engagement hole 314. The guide surface 322 serves to guide the shaft portion 312 of the connector housing 303.

Figure 12:
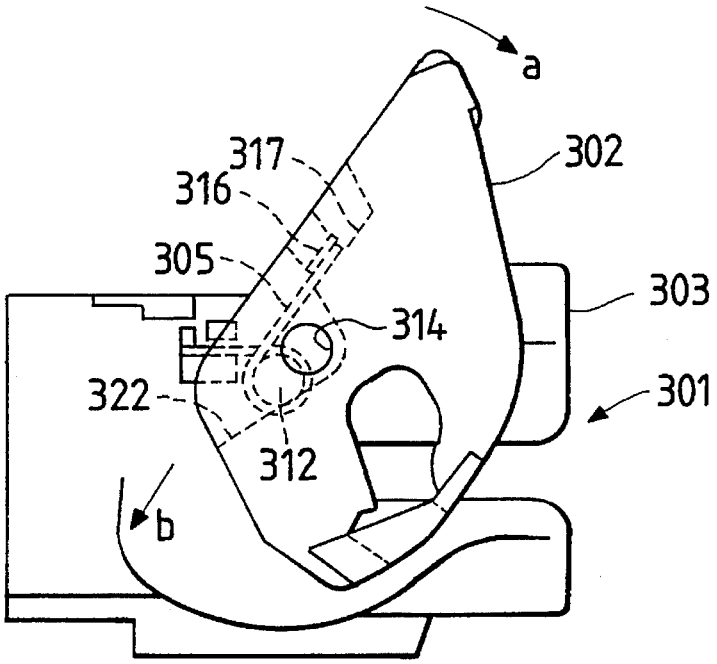
FIG. 12 is a side-elevational view showing a condition in-which a lever is brought from a provisionally-mounted condition to a completely-mounted condition.

In FIG. 10, the distal end portion 305*a* of the lever-side engagement lever 305 of the spring member 304 is inserted into the insertion portion 308 (arch portion) of the lever 302, and in this condition (a lever provisionally-mounted condition) the lever 302 is slightly pivotally moved in a closing direction indicated by arrow a in FIG. 12, and is pushed in a lever mounting direction indicated by arrow b, so that the shaft portion 312 of the connector housing 303 slidingly moves over the guide surface 322 to the engagement hole 314, and is engaged in this engagement hole 314.

Figure 13:
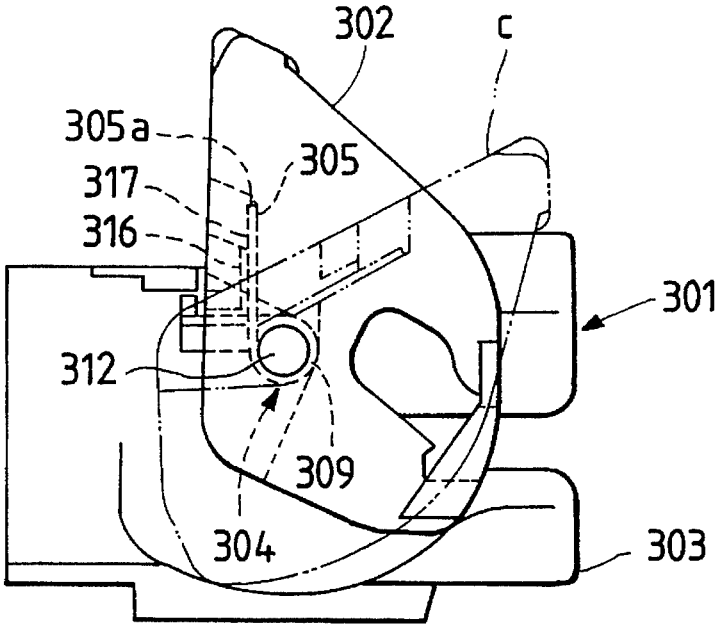
FIG. 13 is a side-elevational view showing the lever-mounted condition.

In a lever-mounted condition shown in FIG. 13, the distal end portion 305*a* of the lever-side engagement lever 305 is passed through the arch portion 316, and is disposed in the engagement groove 317. The lever-side engagement lever 305 is supported by the arch portion 316 disposed closer to the shaft portion 312, and a strong spring reaction force can be obtained with a short spring span. This effect is further enhanced as a result of providing the central portion (coil portion 309) of the spring member 304 at the shaft portion 312 for pivotal movement of the lever 302, and when the lever 302 is released from the lever closed position indicated in a dots-and-dash line c, the lever 302 is positively returned by the strong spring reaction force.

As described above, in the third embodiment of the invention, for mounting the spring member, it is only necessary to engage the coil portion and the connector-side engagement lever with the connector housing, and the lever-side engagement lever does not need to be handled. Therefore, the spring mounting operation is quite easy. Further, by inserting the lever-side engagement lever, projecting from the connector housing, into the insertion portion of the lever, the provisional mounting of the lever is effected, and by slidingly moving the shaft portion along the guide surface of the lever into the engagement hole, the lever mounting operation can be carried out easily.

In the construction of the first embodiment, the lever-side fitting lever 127 of the spring member 124 is in sliding contact with a corner portion 138*a* of the spring end engagement groove, and therefore in accordance with the opening movement of the lever 123, the span of the lever-side engagement lever 127 from the shaft portion 121 to the corner portion 138*a* become long, which results in a problem that the returning movement of the lever 123 is deteriorated. Further, there is encountered a problem that as a result of provision of the coil portion 125 of the spring member 124, the overall size of the connector 118 in its widthwise direction is increased, and there is encountered a problem that the coil portion 125 is liable to be disengaged.

In view of the above problems, a fourth embodiment of the invention seeks to provide a lever fitting-type connector in which the returning movement (opening movement) of a lever is not deteriorated, and the increase of the size of the connector due to the use of a spring member is prevented, and the spring member is less liable to be disengaged.

Fourth embodiment

Figure 14:
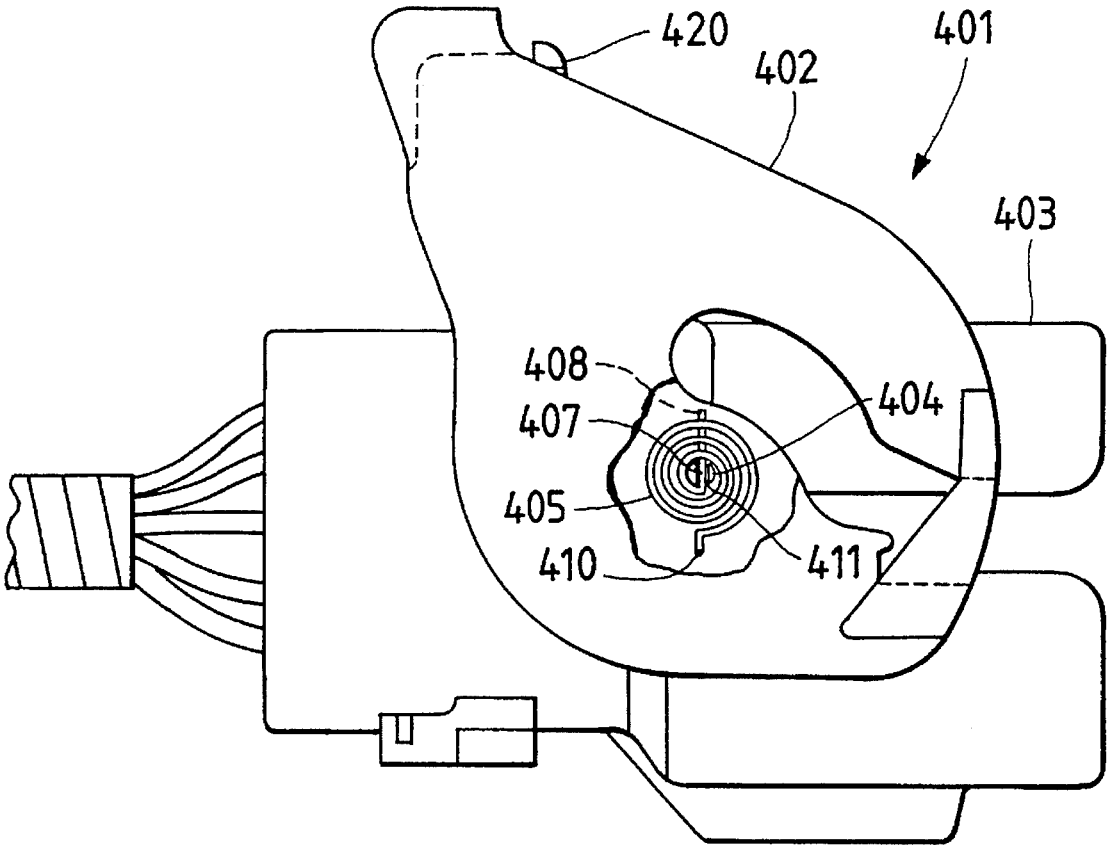
FIG. 14 is a partly-broken, side-elevational view of a fourth embodiment of a lever fitting-type connector of the invention.
Figure 15:
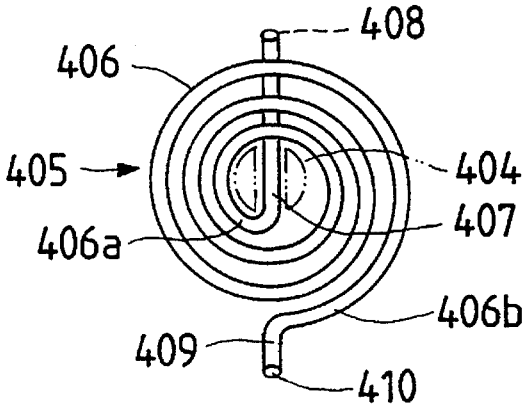
FIG. 15 is a front-elevational view of a spring member.
Figure 16:
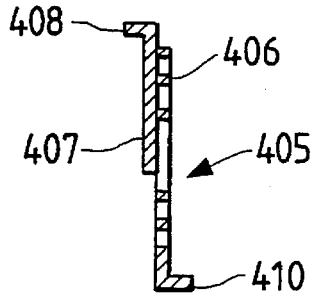
FIG. 16 is a cross-sectional view of the spring member.

FIG. 14 shows a fourth embodiment of a lever fitting-type connector of the invention.

This lever fitting-type connector 401 is characterized in that a volute spring member 405 is mounted on a shaft portion 404 of a connector housing 403 of a synthetic resin for a connector-fitting lever 402.

As shown in FIGS. 15 to 19, the spring member 405 includes a volute portion 406 volute in a one-dimensional direction, that is, in a common plane, a straight portion 407 which extends from a wire 406*a* at an inner peripheral portion of the volute portion 406, and further extends through the center of the volute portion 406 outwardly in contact with the lower side of the volute portion 406, one bent end portion 408 formed by perpendicularly bending a distal end portion of the straight portion 407 in a direction facing away from the volute portion 406, a projecting portion 409 which extends from a wire 406*b* at an outer peripheral portion of the volute portion 406, and projects in a direction opposite to the straight portion, and the other bent end portion 410 formed by perpendicularly bending a distal end portion of the projecting portion 409 in a direction opposite to the one bent end portion 408.

Figure 17:
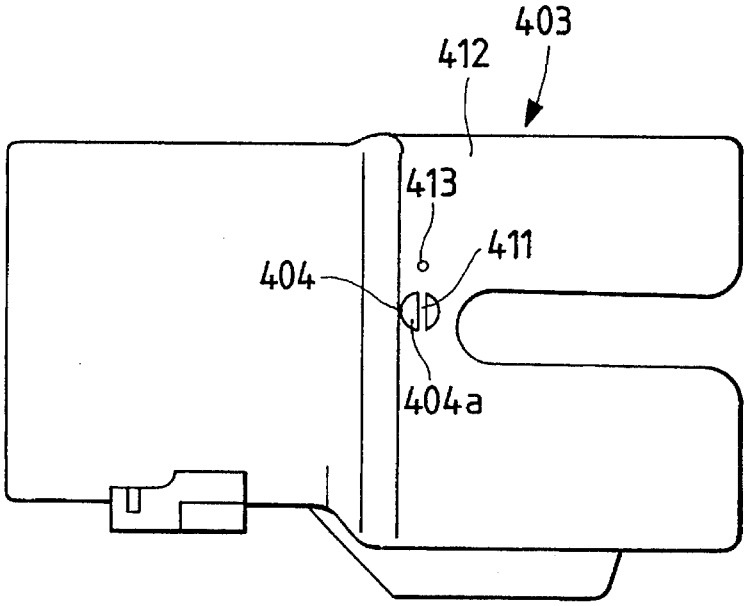
FIG. 17 is a side-elevational view of a connector housing.

The spring member 405 is fixedly mounted on the shaft portion 404 of the connector housing 403. More specifically, as shown in FIG. 17, a slit-like engagement groove 411 is formed in an end face 404*a* of the shaft portion 404, the engagement groove 411 passing through the center of the end face 404*a* and also extending axially. The straight portion 407 of the spring member 405 is passed through and engaged in the engagement groove 411.

Figure 18:
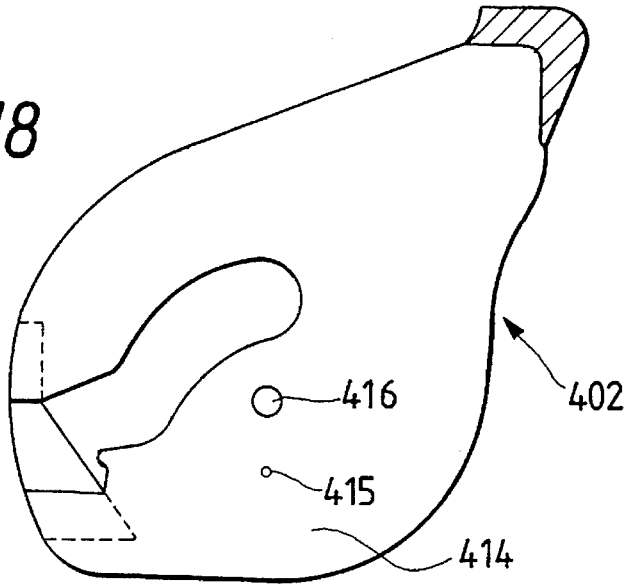
FIG. 18 is a side-elevational view showing an inner side of a lever.

An insertion hole 413 for the one bent end portion 408 at the distal end of the straight portion of the spring member 405 is formed in one side wall 412 of the connector housing 403. The insertion hole 413 is disposed on a line of extension of the engagement groove 411 in the shaft portion 404. As shown in FIG. 18 showing the inner side of the lever 402, an insertion hole 415 for the other bent end portion 410 at the distal end of the spring member 405 is formed in an inner surface 414 of the lever 402. The insertion hole 415 is provided in the vicinity of the hole 416 receiving the shaft portion 404 of the connector housing 403.

Figure 19A:
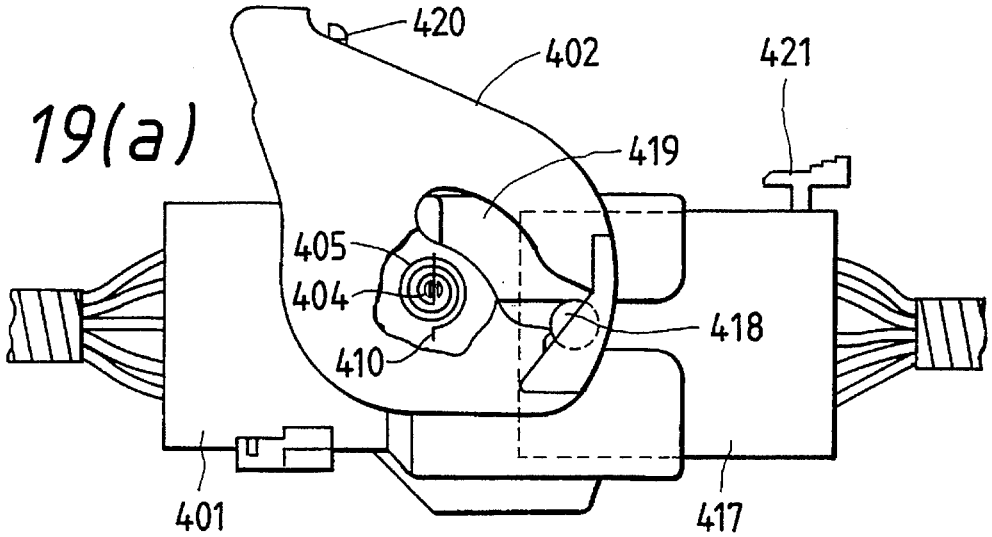
FIGS. 19(*a*) to 19(*c*) are partly-broken, side elevational views sequentially showing the process of fitting connectors together by operating the lever.
Figure 19B:
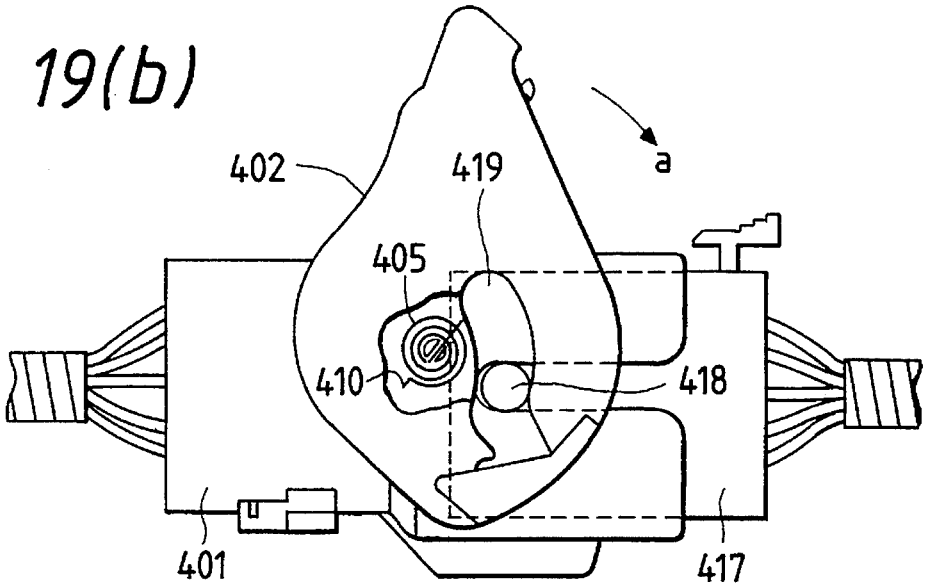
Figure 19C:
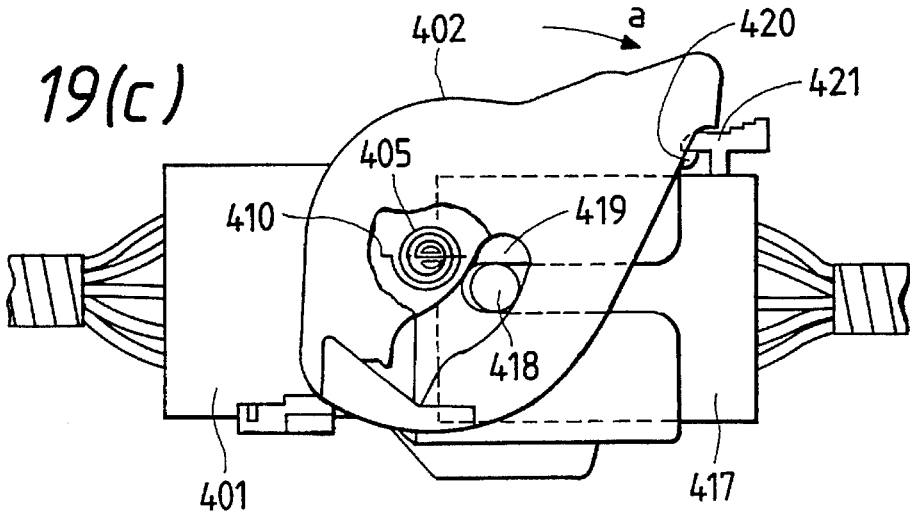

FIGS. 19(*a*) to 19(*c*) show the process of fitting male and female connectors 417 and 401 together by operating the lever. In an open condition of the lever 402 (FIG. 19(*a*), the volute spring member 405 is expanded circumferentially to have an enlarged diameter. In this condition, the mating male connector 417 is fitted in a front portion of the female connector 401, and projected pins 418 on the male connector 417 are engaged respectively in inlet portions of cam grooves 419 in the lever 402.

As shown in FIG. 19(*b*), the lever 402 is pivotally moved in a closing direction (indicated by arrow a) to draw the projected pins 418 into the respective cam grooves 419, thereby inserting the male connector 417. As the other bent end portion 410, fixed to the lever 402, moves in a spring winding direction, the diameter of the spring member 405 is gradually decreasing. Then, in a closed condition (FIG. 19(*c*) in which the lever 402 is tilted forwardly, the two connectors 401 and 417 are completely fitted together, and a lock pawl 420, formed on the front end of the lever, is engaged with a retaining arm 421 of the male connector 417.

For disengaging the connectors 401 and 417 from each other, the retaining arm 21 is pressed to release the engagement of the lock pawl 420, and then the two connectors 401 and 417 are pulled away from each other, so that the lever 402 is returned in a reverse direction. Here, the lever 402 in a free condition is tilted in the closing direction, and the hand is released from this lever, so that the volute spring member 405 produces a generally constant, stable spring reaction force over an entire opening stroke of the lever 402, thereby positively returning the lever 402.

As described above, in the fourth embodiment, since the volute spring member is mounted on the shaft portion about which the lever is pivotally moved, this spring member produces a generally constant, stable urging force over the entire opening stroke of the lever, thereby positively returning the lever. With this construction, the positioning of the lever at the time of fitting the connectors together can be effected positively, and therefore a lever-returning operation is not needed, and the burden on the operator is reduced. And besides, even if the connectors are fitted together incompletely, the operator can find such an incompletely-fitted condition with the eyes from the open condition of the lever. Moreover, the spring member is volute in a one-dimensional direction, and does not occupy much space in a direction (a direction of the width of the connector) perpendicular to the spring member, and therefore the overall size of the connector is compact. Furthermore, simultaneously with the mounting of the lever, the spring member on the shaft portion is held between the connector housing and the lever, and therefore the spring member is prevented from being disengaged.

What is claimed is:

1. A lever fitting-type connector comprising:

a lever returning spring having a connector-side engagement lever and a lever-side engagement lever which extends from a coil portion;

a connector housing including a shaft portion and one spring end engagement portion which are formed on an outer wall surface thereof, and the one spring end engagement portion engaged with the connector-side engagement lever; and a U-shaped lever having an engagement hole for the shaft-portion and another spring end engagement portion which is engaged with the lever side engagement lever wherein the connector-side engagement lever is linear and the one spring end engagement portion includes a recessed portion defined by a side wall and a bottom wall, an insertion hole communication with the recessed portion for receiving a distal end of the connector-side engagement lever and a retaining pawl extending from said side wall with a lever receiving-gap defined by said pawl and said bottom wall in which said connector-side engagement lever is received and retained.

2. A lever fitting-type connector as claimed in claim 1, wherein said spring is secured to said one spring engagement portion by inserting said distal end into said insertion hole in an inclined manner and, thereafter pushing said spring such that said connector-side engagement lever forcibly slides past said retaining pawl so as to be retained thereby.

3. A lever fitting-type connector as claimed in claim 1, wherein said engagement hole extends in a direction parallel to a longitudinal direction of said shaft portion.

4. A lever fitting-type connector, comprising:

a lever returning spring having a connector-side engagement lever and a lever-side engagement lever which extends from a coil portion;

a connector housing including a shaft portion and one spring end engagement portion which are formed on an outer wall surface thereof, and the one spring end engagement portion engaged with the connector-side engagement lever; and a U-shaped lever having an engagement hole for the shaft-portion and another spring end engagement portion which is engaged with the lever side engagement lever, wherein the other spring end engagement portion includes a longitudinal insertion portion for engaging the lever-side engagement lever, and the longitudinal insertion portion is formed at an inner wall surface of the U-shaped lever, wherein when the coil portion is engaged with the shaft portion and the connector-side engagement lever is engaged with the one spring end engagement portion, the lever-side engagement lever extends outwardly from the connector housing in an upstanding manner so that the lever-side engagement lever can be inserted into the insertion portion, and wherein the inner wall surface of the U-shaped lever is provided with the notched portion having a guide surface for guiding the shaft portion into engagement with said engagement hole, and said notched portion extends from an outer edge of the inner wall surface to the engagement hole.

5. A lever fitting-type connector comprising:

a connector housing including a shaft portion and one spring end engagement portion which are formed on an outer wall surface thereof;

a U-shaped lever having an engagement hole for the shaft portion and another spring end engagement portion; and a volute spring member, a central portion of the volute spring member fixedly mounted on the shaft portion, one end portion of the volute spring member engaged with the one spring end engagement portion, the other end portion of the volute spring member engaged with the other spring end engagement portion.

6. A lever fitting-type connector as claimed in claim 5, wherein the volute spring member includes a volute portion voluting in an one-dimensional direction, a straight portion which extends from an inner peripheral portion of the volute portion, and further extends through a center of the volute portion outwardly, one bent end portion formed at a distal end of the straight portion and the other bend end portion extending from an outer peripheral portion of the volute portion, and the one bend end portion is bent in a direction opposite to the other bend end portion.

7. A lever fitting-type connector as claimed in claim 6, wherein the shaft portion has an engagement groove for the straight portion, the connector housing has an insertion hole for the one bent end portion, and the U-shaped lever has an insertion hole for the other bent end portion.

* * * * *